US006386363B1

(12) United States Patent
Huang

(10) Patent No.: US 6,386,363 B1
(45) Date of Patent: May 14, 2002

(54) COMPACT TOOL HOLDER AND DISPLAY SYSTEM

(75) Inventor: Steve Huang, Taichung Hsien (TW)

(73) Assignee: Stanley Chiro International Ltd., Taichung-Hsien (TW)

( * ) Notice: Subject to any disclaimer, the term of this patent is extended or adjusted under 35 U.S.C. 154(b) by 0 days.

(21) Appl. No.: 09/826,824

(22) Filed: Apr. 6, 2001

(51) Int. Cl.[7] ..... B65D 85/02
(52) U.S. Cl. ..... 206/378; 206/1.5; 211/70.6
(58) Field of Search ..... 206/372–378, 206/1.5, 493; 211/70.6

(56) References Cited

U.S. PATENT DOCUMENTS 5,398,823 A * 3/1995 Anders ..... 211/70.6
5,715,951 A * 2/1998 Dembicks ..... 211/70.6
5,725,107 A * 3/1998 Dembicks ..... 211/70.6
5,855,284 A * 1/1999 Dembicks ..... 211/70.6
5,897,001 A * 4/1999 Dembicks ..... 211/70.6
6,070,745 A 6/2000 Dembicks
6,092,655 A * 7/2000 Ernst ..... 206/378
6,095,329 A * 8/2000 Kao ..... 206/378
6,168,018 B1 * 1/2001 Ramsey et al. ..... 206/378

* cited by examiner

*Primary Examiner*—Jim Foster
(74) *Attorney, Agent, or Firm*—Finnegan, Henderson, Farabow, Garrett & Dunner, L.L.P.

(57) ABSTRACT

A holder system for holding at least one socket includes an elongated base, which has a slide slot. Each of a plurality of socket receiving members has a lower retaining portion retained axially and movably on the base, and an upper insert portion that is formed integrally on an upper end of the lower retaining portion and that is adapted to extend into the socket. The upper insert portion includes an integral resilient unit, which is formed with a nub unit that is adapted to be biased to engage a groove in the socket. A lock rod is received slidably within the slide slot in the base, and is disposed under the socket receiving members. A top surface of the lock rod is formed integrally with an upwardly projecting pushing rib unit that is adapted to press the resilient unit against the inner surface of the socket so as to engage the nub unit with the groove in the socket, thereby preventing removal of the socket from the socket receiving member.

8 Claims, 8 Drawing Sheets

COMPACT TOOL HOLDER AND DISPLAY SYSTEM

BACKGROUND OF THE INVENTION

1. Field of the Invention

This invention relates to a tool holder and display system, more particularly to a socket holder and display system, which can lock a plurality of sockets on a base.

2. Description of the Related Art

When displaying a plurality of sockets for sale, it is necessary to lock and position the same on a base. Referring to FIGS. 1, 2, and 3, a conventional compact tool holder and display system disclosed in U.S. Pat. No. 6,070,745 is shown to include an elongated base 1, a socket receiving member 2, and a lock member 3. The base 1 is formed with a dovetail groove 101 and two retaining lips 102 that define an opening of the groove 101 therebetween. The socket receiving member 2 has a horizontal bottom wall 201, two vertical base walls 202, an interior space 203 defined between the base walls 202 and between two resilient retaining walls 204, and two nubs 205 formed on outer surfaces of the retaining walls 204. The bottom wall 201 is confined within the dovetail groove 101 in the base 1. The base walls 202 and the resilient retaining walls 204 engage an aperture 401 in a socket 4 in such a manner that the nubs 205 extend into a nub engaging groove 402 in the socket 4. The lock member 3 has a horizontal plate-shaped lock stop 301 and a lock body 302 that is inserted into the space 203 in the socket receiving member 2 and that abuts against the resilient retaining walls 204, there by preventing disengagement of the nubs 205 from the groove 402 in the socket 4. During assembly, the socket 4 is sleeved first on the socket receiving member 2 so as to engage the nubs 205 with the groove 402. Subsequently, the lock body 302 of the lock member 3 is inserted into the space 203 in the socket receiving member 2, and the lock stop 201 of the socket; receiving member 2 is inserted into the dovetail groove 101 in the base 1, thereby completing the assembly of these elements 1, 2, 3, and 4. As such, it is time-consuming for the socket 4 to be mounted on and dismounted from the base 1.

SUMMARY OF THE INVENTION

An object of this invention is to provide a compact tool holder and display system, in which a socket can be easily mounted on and dismounted from a base.

According to this invention, a holder system for holding at least one socket includes an elongated base, which. has a slide slot that extends along the length thereof. Each of a plurality of socket receiving members has a lower retaining portion retained axially and movably on the base, and an upper insert portion that is formed integrally on an upper end of the lower retaining portion and that is adapted to extend into the socket. The upper insert portion includes an integral resilient unit, which is formed with a nub unit that is adapted to be biased to engage a groove in the socket. A lock rod is received slidably within the slide slot in the base, and is disposed under the socket receiving members. A top surface of the lock rod is formed integrally with an upwardly projecting pushing rib unit that is adapted to press the resilient unit against the inner surface of the socket so as to engage the nub unit with the groove in the socket, thereby preventing removal of the socket from the socket receiving member.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
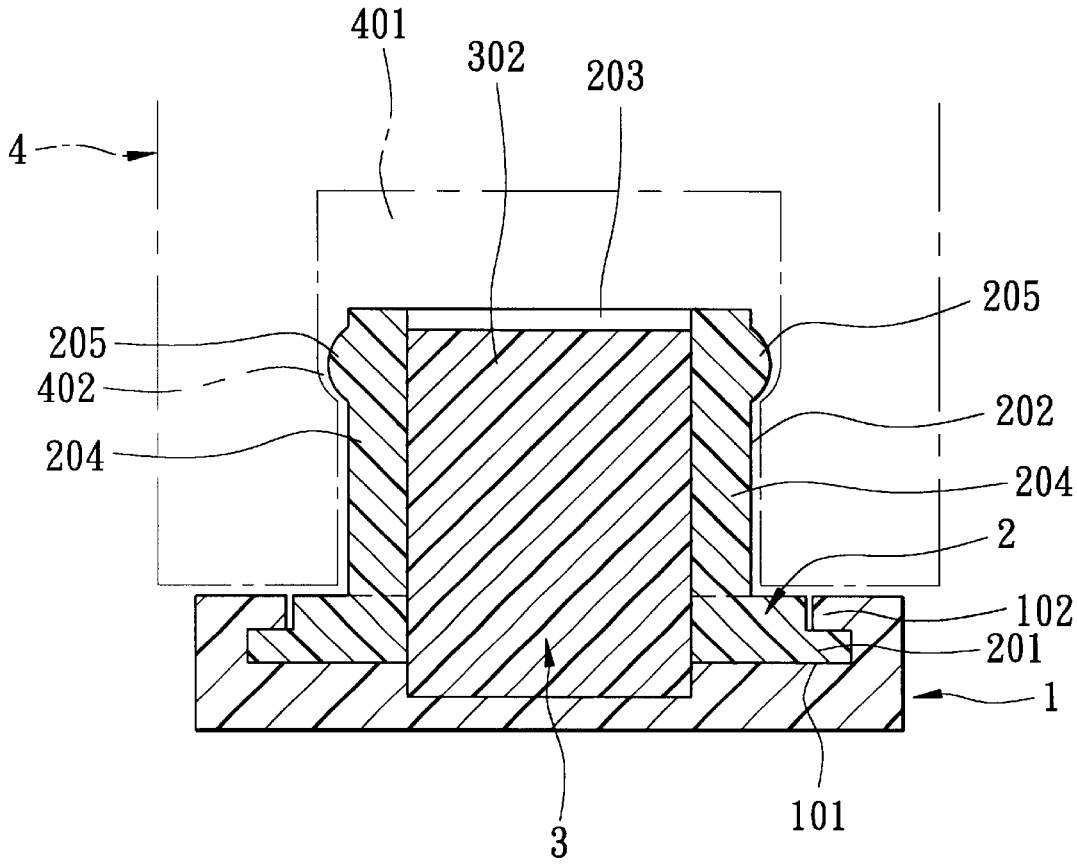
FIG. 1 PRIOR ART
FIG. 1 is a sectional view of a conventional compact tool holder and display system, which is disclosed in U.S. Pat. No. 6,070,745.
Figure 2:
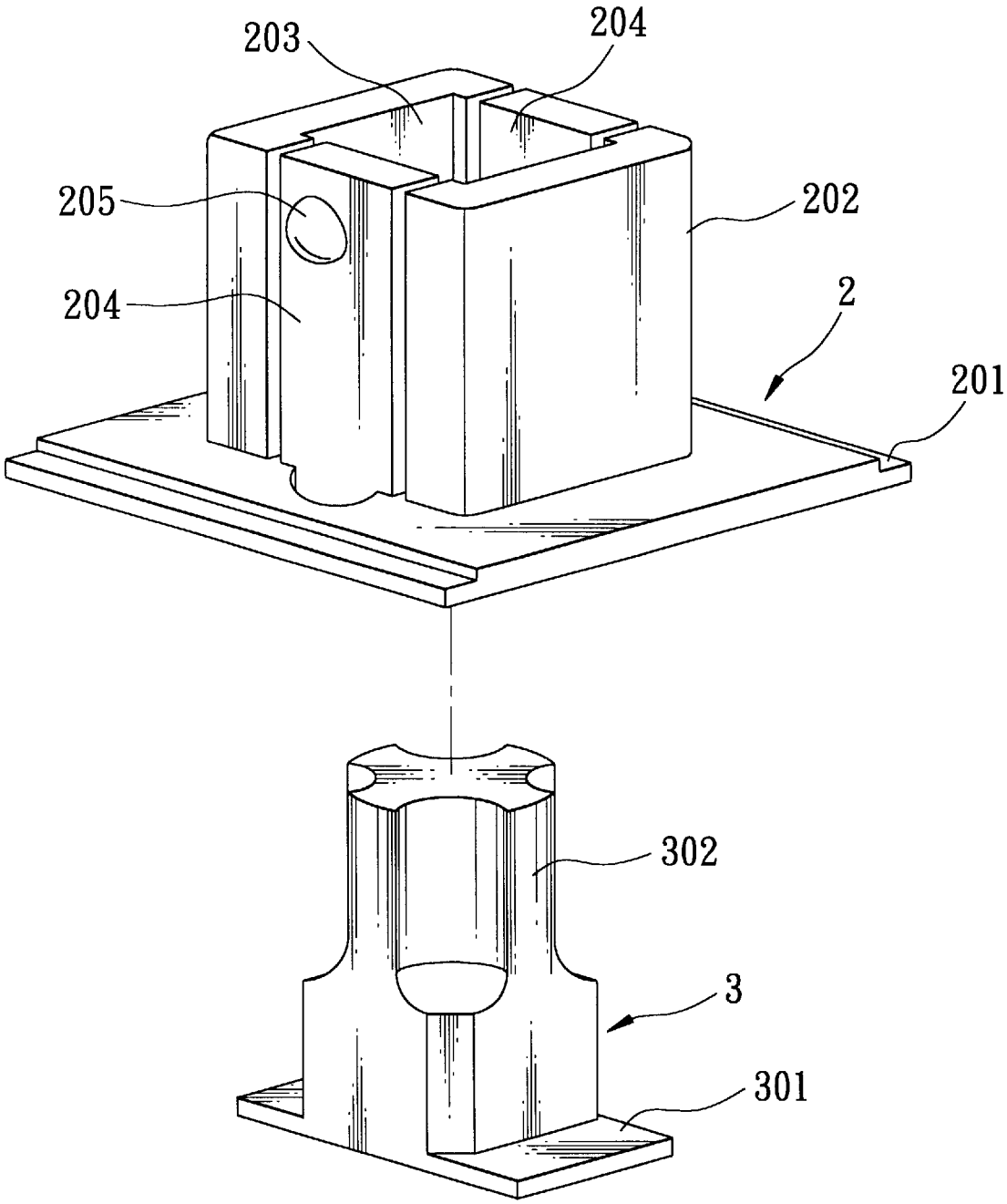
FIG. 2 PRIOR ART
FIG. 2 is an exploded view of a socket receiving member and a lock member of the conventional system shown in FIG. 1.
Figure 3:
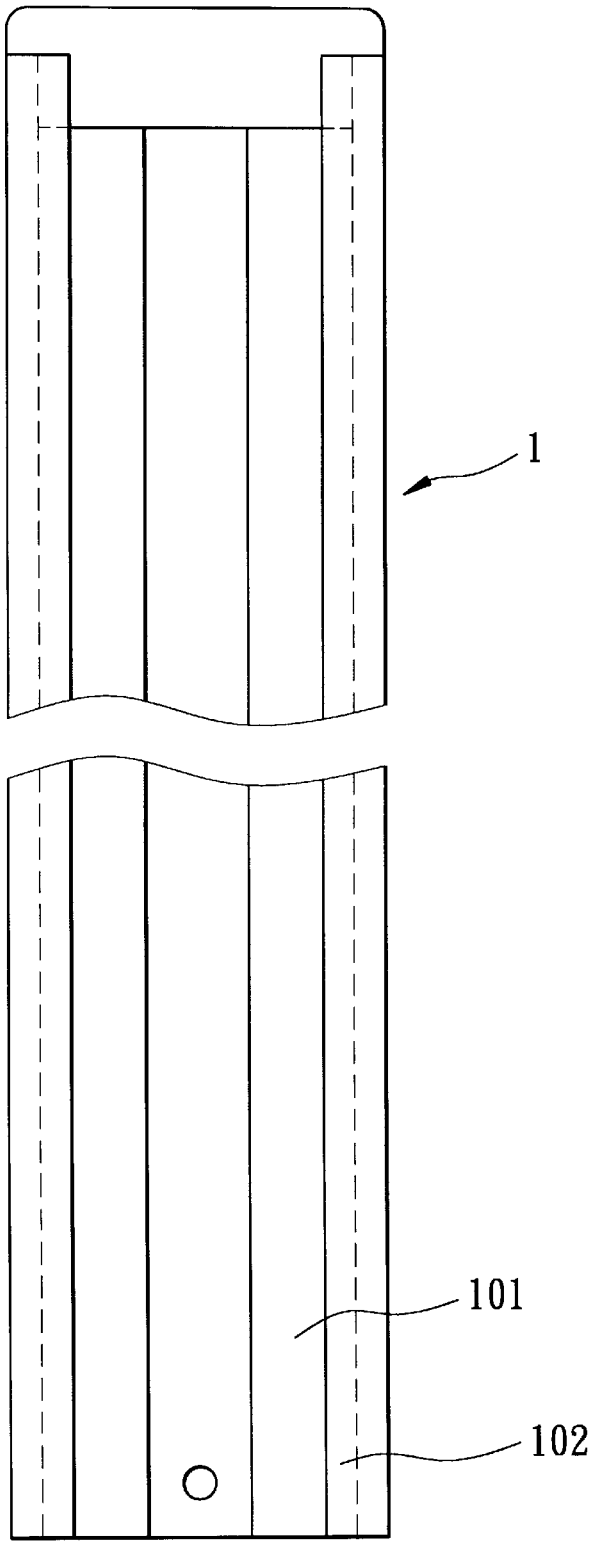
FIG. 3 is a top view of a base of the conventional system shown in FIG. 1.
Figure 4:
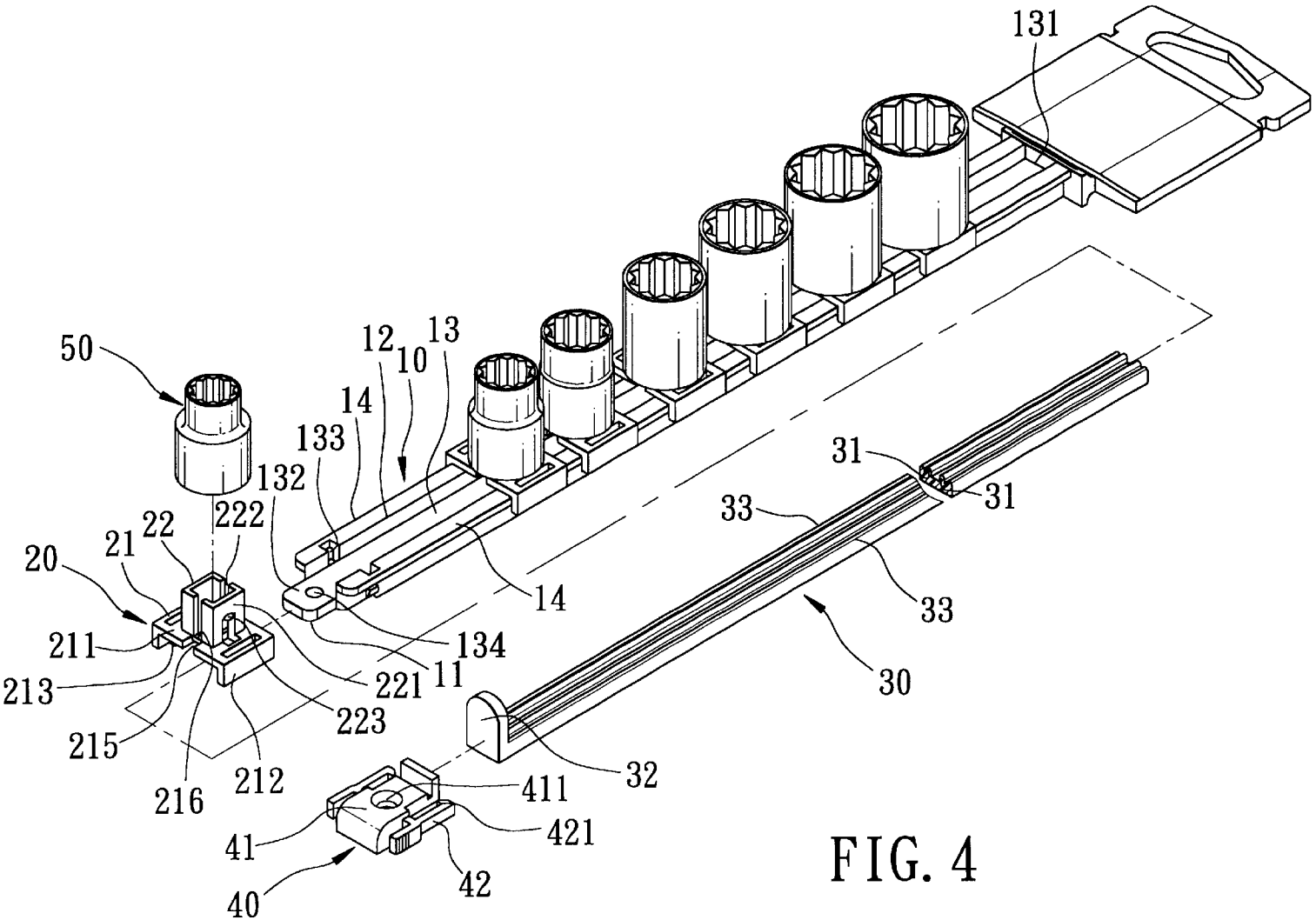
FIG. 4 is a partly exploded view of a first preferred embodiment of a compact tool holder and display system according to this invention.

Before the present invention is described in greater detail with reference to the preferred embodiments, it would be understood that similar elements and structures are designated by like reference numbers throughout the entire disclosure. Referring to FIGS. 4, 5, 6, and 7, a first preferred embodiment of a compact tool holder and display system according to this invention is shown to include an elongated base 10, a plurality of socket receiving members 20, a lock rod 30, and an end piece 40.

The base 10 has a top surface, which is formed with a slide slot 13 that extends along the length thereof.

Each of the socket receiving members 20 is inserted into an aperture 51 in a socket 50, and has a lower retaining portion 21 retained axially and movably on the base 10, and an upper insert portion 22 that is formed integrally on an upper end of the lower retaining portion 21 and that extends into the socket 50. The upper insert portion 22 includes an integral resilient unit, which is formed with a nub unit that is biased to engage a nub engaging groove 52 in an inner surface of the socket 50.

The lock rod 30 is received slidably within the slide slot 13 in the base 10, and is disposed under the socket receiving members 20. A top surface of the lock rod 30 is formed integrally with an upwardly projecting pushing rib unit that is adapted to press the resilient unit against the inner surface of the socket 50 so as to engage the nub unit with the groove 52 in the socket 50, thereby preventing removal of the socket 50 from the socket receiving member 20.

The base 10 has a horizontal bottom wall 11, two vertical side walls 12 extending integrally and upwardly from two opposite sides of the bottom wall 11 so as to define the slide slot 13 between the side walls 12 and above the bottom wall 11, and two horizontal guiding ribs 14 that are formed respectively on upper ends of the side walls 12 and that extend away from each other. The lower retaining portion 21 of the socket receiving member 20 includes two horizontal top plates 211, two vertical side plates 212, two retaining ribs 213, and a horizontal connecting sheet 216. The top plates .211 are disposed at the same level. The connecting sheet 216 has two opposite sides, each of which is formed integrally with a middle portion of a respective one of the inner sides of the top plates 211. The vertical side plates 212 extend respectively, integrally, and downwardly from the outer sides of the top plates 211, and flank the base 10. The retaining ribs 213 extend respectively, integrally, and inwardly from lower ends of the side plates 212, thereby defining two guiding grooves 214 between the top plates 211 and the retaining ribs 213, into which the guiding ribs 14 of the base 10 are inserted respectively, thereby retaining the socket receiving member 20 on the base 10. Two notches 215 are defined among the connecting sheet 216 and the top plates 211.

In this embodiment, the resilient unit of the upper insert portion 22 of the socket receiving member 20 includes two resilient elements 221, which are formed respectively and integrally on the top plates 211 and which are spaced apart from each other. Two slits 222 are defined between the resilient elements 221. Each of the resilient elements 221 is shaped as a vertical plate, which has a generally U-shaped cross-section and an outer surface. The nub unit includes two nubs 223 that are formed respectively and integrally on the outer surfaces of the resilient elements 221.

Figure 5:
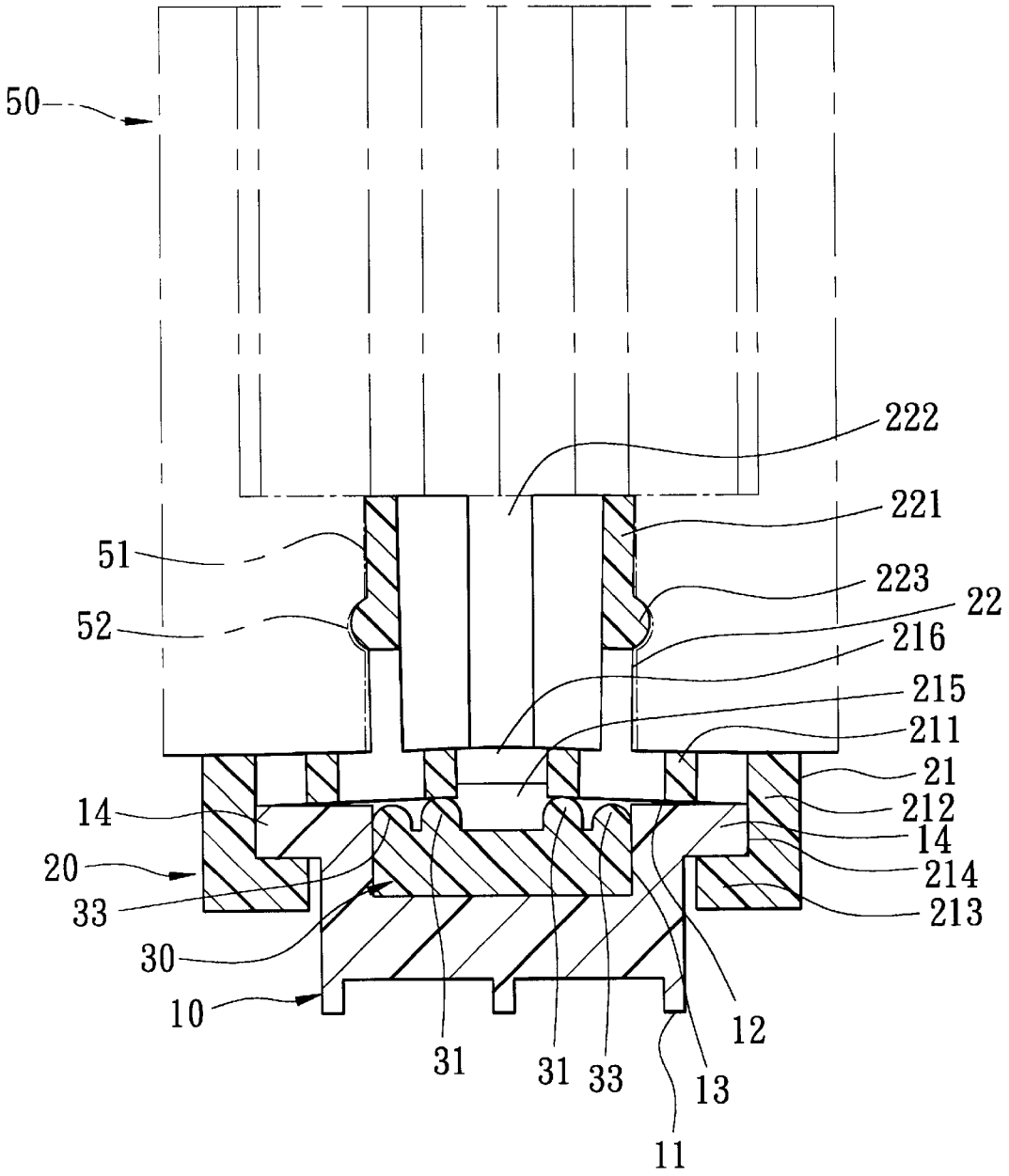
FIG. 5 is a sectional view of the first preferred embodiment, illustrating how a socket is mounted thereon.
Figure 6:
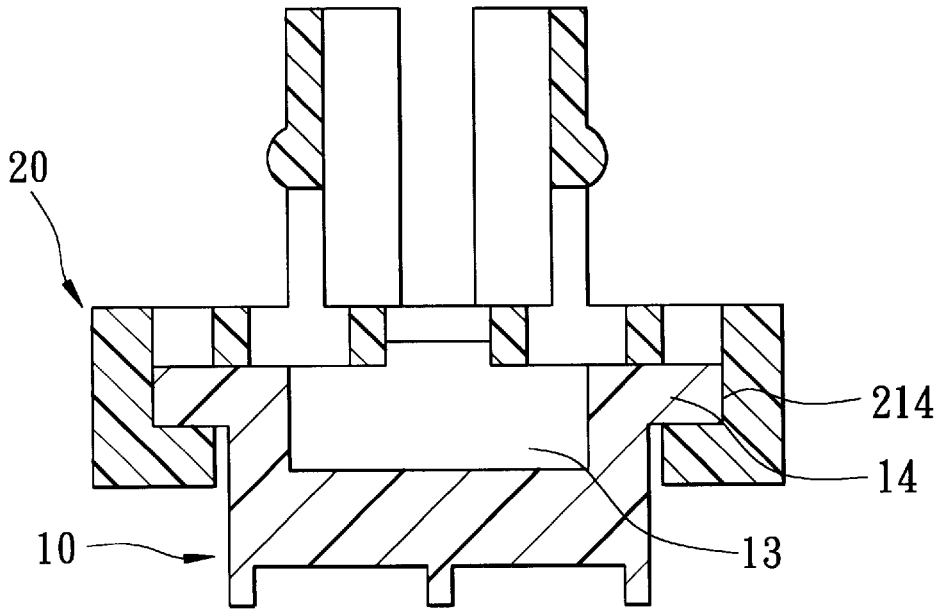
FIG. 6 is a sectional view, illustrating how a socket receiving member is mounted on a base.
Figure 7:
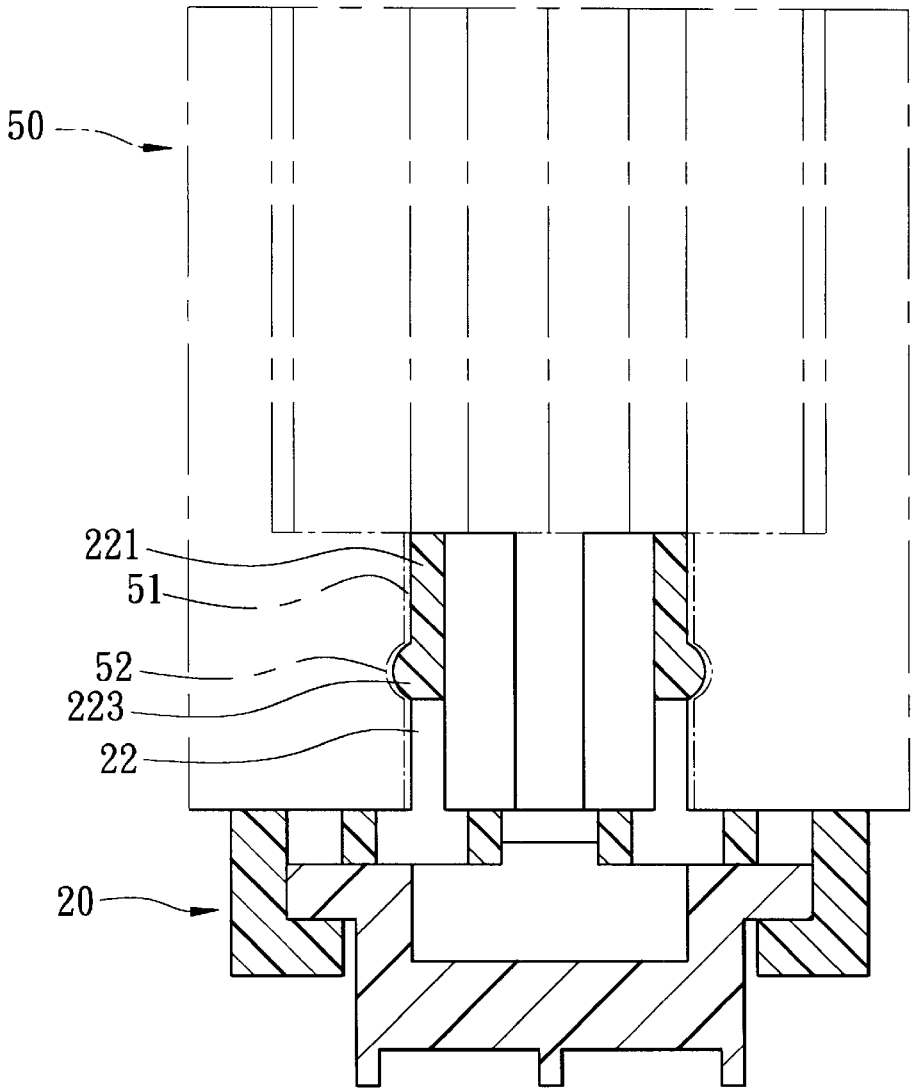
FIG. 7 is a sectional view of a base and a socket receiving member of the first preferred embodiment.

The pushing rib unit includes two spaced-apart pushing ribs 31, which extend from an intermediate portion of the lock member 30 and along length of the lock member 30 and which press respectively and upwardly against the inner sides of the top plates 211 so as to turn the resilient elements 221 from a vertical position shown in FIG. 6 to a somewhat outwardly inclined position shown in FIG. 5, in which the resilient elements 221 press against the inner surface of the socket 4.

The lock member 30 further has two integral reinforcing ribs 33, which extend respectively and upwardly from two opposite sides thereof.

The slide slot 13 in the base 10 has a closed end 131 and an open end 132. The base 10 further has two aligned retaining holes 133 formed respectively through the side walls 12 near the open end 131, and a fastener hole 134 formed through the bottom wall 11 near the open end 132. The lock member 30 is formed integrally with a vertical actuating plate 32 that is received within the open end 132 of the slide slot 13 in the base 10.

The end piece 40 has a plate body 41 that abuts against the actuating plate 32 and that is formed with a hole 411 aligned with the fastener hole 134 in the base 10 for permitting extension of a lock bolt (not shown), and two resilient arms 42 that are formed respectively and integrally on two opposite sides of the plate body 41 and that extend in a longitudinal direction of the slide slot 13. Each of the resilient arms 42 is formed with an end barb 421, which engages a respective one of the retaining holes 133 in the base 10, thereby retaining the lock member 30 on the base 10. Each of the side walls 12 of the base 10 is disposed between the plate body 41 and a respective one of the resilient arms 42.

Figure 8:
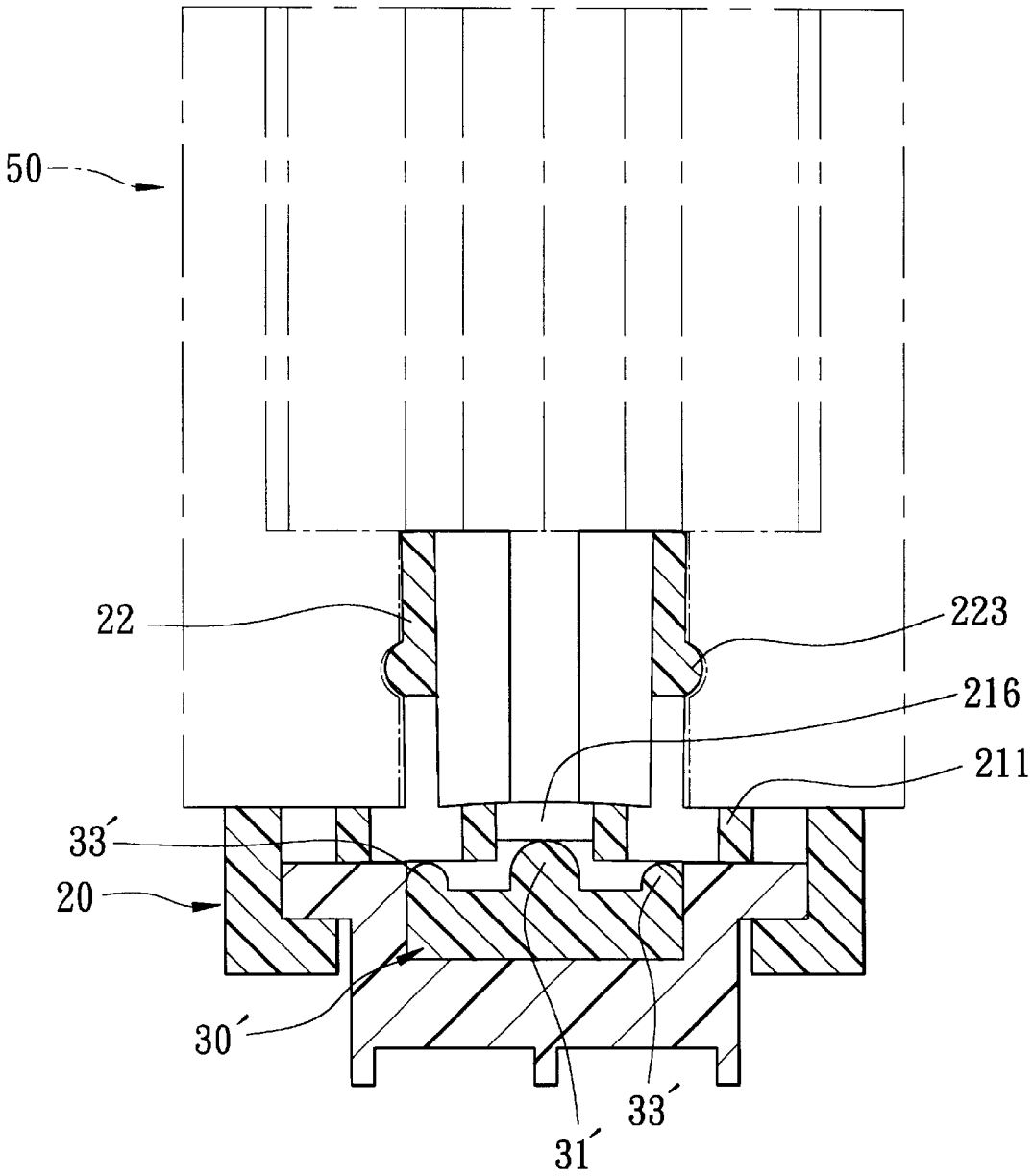
FIG. 8 is a sectional view of a second preferred embodiment of a compact tool holder and display system according to this invention.

FIG. 8 shows a modified pushing rib unit, which includes a pushing rib 31' that extends from an intermediate portion of the lock member 30' and along the length of the lock member 30' and that presses upward against the connecting sheet 216. The lock member 30' also has two integral reinforcing ribs 33', which extend respectively and upwardly from two opposite sides thereof.

With this invention thus explained, it is apparent that numerous modifications and variations can be made without departing the scope and spirit of this invention. It is therefore intended that this invention be limited only as indicated by the appended claims.

I claim:

1. A holder system for holding at least one socket, the socket having an inner surface that is formed with a nub engaging groove, said system comprising:

an elongated base having a top surface, which is formed with a slide slot that extends along length thereof;

a plurality of socket receiving members, each of which has a lower retaining portion retained axially and movably on said base, and an upper insert portion that is formed integrally on an upper end of said lower retaining portion and that is adapted to extend into the socket, said upper insert portion including an integral resilient unit which is formed with a nub unit that is adapted to be biased to engage the groove in the socket; and a lock rod received slidably within said slide slot in said base and disposed under said: socket receiving members, said lock rod having a top surface, which is formed integrally with an upwardly projecting pushing rib unit that is adapted to press said resilient unit against the inner surface of the socket so as to engage said nub unit with the groove in the socket, thereby preventing removal of the socket from said socket receiving member.

2. The holder system as claimed in claim 1, wherein said base has a horizontal bottom wall, two vertical side walls extending integrally and upwardly from two opposite sides of said bottom wall so as to define said slide slot between said side walls and above said bottom wall, and two horizontal guiding ribs that are formed respectively on upper ends of said side walls and that extend away from each other, said lower retaining portion of said socket receiving member including:

two horizontal top plates disposed at the same level, each of said top plates having an inner side and an outer side;

a horizontal connecting sheet having two opposite sides, each of which is formed integrally with a middle portion of a respective one of said inner sides of said top plates;

two vertical side plates extending respectively, integrally, and downwardly from said outer sides of said top plates, and flanking said base; and two horizontal retaining ribs extending respectively, integrally, and inwardly from lower ends of said side plates, thereby defining two guiding grooves between said top plates and said retaining ribs, into which said guiding ribs of said base are inserted respectively, thereby retaining said socket receiving member on said base.

3. The holder system as claimed in claim 2, wherein said resilient unit of said upper insert portion of said socket receiving member includes two resilient elements, which are formed respectively and integrally on said top plates and which are spaced apart from each other, each of said resilient elements being shaped as a vertical plate, which has a generally U-shaped cross-section and an outer surface, said nub unit including two nubs that are formed respectively and integrally on said outer surfaces of said resilient elements, said pushing rib unit pressing upward against assembly of said connecting sheet and said inner sides of said top plates so that said resilient elements are somewhat inclined outward, thereby pressing against the inner surface of the socket.

4. The holder system as claimed in claim 3, wherein said pushing rib unit includes two spaced-apart pushing ribs, which extend from an intermediate portion of said lock member and along length of said lock member and which press respectively and upwardly against said inner sides of said top plates.

5. The holder system as claimed in claim 4, wherein said lock member further has two integral reinforcing ribs, which extend respectively and upwardly from two opposite sides thereof.

6. The holder system as claimed in claim 3, wherein said pushing rib unit includes a pushing rib, which extends from an intermediate portion of said lock member and along length of said lock member and which presses upward against said connecting sheet.

7. The holder system as claimed in claim 6, wherein said lock member further has two integral reinforcing ribs, which extend respectively and upwardly from two opposite sides thereof.

8. The holder system as claimed in claim 2, wherein said slide slot in said base has a closed end and an open end, said base further having two aligned retaining holes formed respectively through said side walls near said open end, and a fastener hole formed through said bottom wall near said open end, said lock member having an end, which is formed integrally with a vertical actuating plate that is received within said open end of said slide slot in said base, said system further including an end piece, which has a plate body that abuts against said actuating plate and that has a hole aligned with said fastener hole in said base, and two resilient arms that are formed respectively and integrally on two opposite sides of said plate body and that extend in a longitudinal direction of said slide slot, each of said resilient arms being formed with an end barb, which engages a respective one of said retaining holes in said base, thereby retaining said lock member on said base, each of said side walls of said base being disposed between said plate body of said end piece and a respective one of said resilient arms of said end piece.

* * * * *